United States Patent [19]

Selivanov et al.

[11] 4,287,674

[45] Sep. 8, 1981

[54] DRYING INSTALLATION

[76] Inventors: Anatoly G. Selivanov, Donskaya ulitsa, 24, kv. 110; Grigory P. Yakovlev, Flotskaya ulitsa, 26, kv. 63; Vladimir I. Khodyrev, Kerchenskaya ulitsa, 20, kv. 120; Valery V. Zhivetin, ulitsa Sofii Kovalevskoi, 4, kv. 123, all of Moscow, U.S.S.R.

[21] Appl. No.: 70,146

[22] Filed: Aug. 27, 1979

[30] Foreign Application Priority Data

Dec. 13, 1978 [SU] U.S.S.R. ..... 2691050

[51] Int. Cl.[3] ..... E04H 12/34

[52] U.S. Cl. ..... 34/201; 34/218; 312/3; 312/284

[58] Field of Search ..... 34/148, 151, 201, 218; 312/3, 213, 284

[56] References Cited

U.S. PATENT DOCUMENTS

| | | | |
|---|---|---|---|
| 1,266,001 | 5/1918 | Dickason | 34/151 |
| 2,406,724 | 8/1946 | Waterman | 34/201 |
| 2,701,921 | 2/1955 | Strongson | 34/201 |
| 2,705,377 | 4/1955 | Konstandt | 34/201 |
| 3,739,492 | 6/1973 | Brooks | 34/151 |

FOREIGN PATENT DOCUMENTS

| | | | |
|---|---|---|---|
| 1119219 | 12/1961 | Fed. Rep. of Germany | 34/151 |
| 1525253 | 4/1968 | France | 34/151 |
| 235634 | 5/1969 | U.S.S.R. | |

*Primary Examiner*—Larry I. Schwartz

*Attorney, Agent, or Firm*—Robert E. Burns; Emmanuel J. Lobato; Bruce L. Adams

[57] ABSTRACT

Drying tower installation having a folding chamber built up of a number of individual interconnected sections formed by similarly shaped bearing members provided with an elastic outer covering. The top bearing member of an upper section has a means for holding the chamber on a support. Provision is also made for a chamber raising means, comprising at least three wire ropes which with one of their ends fixed on the bottom bearing member of the lower section, and with the other ends thereof linked to a rope reeling mechanism.

14 Claims, 11 Drawing Figures

DRYING INSTALLATION

FIELD OF THE INVENTION

The present invention relates to devices for drying solid materials or products by virtue of their dehumidification, viz., to drying installations.

The invention can find application in intermittentor continuous-action industrial drying equipment featuring convective, radiation, conductive, or combination-type heat reception. The herein-proposed drying installation is usable both indoors, in industrial structures, and outdoors, in the open air under conditions of various climatic zones, especially under adverse climatic conditions (hard frosts, increased humidity, marine environmental conditions). The drying installation can be used for desiccating diverse materials, products and objects, as well as for providing hot-air curtains.

BACKGROUND OF THE INVENTION

Drying installations for desiccating various products by virtue of dehydrating are under very widespread application both in industry and in some other fields of the national economy, e.g. in the textile industry for drying fibres, yarn, threads and fabric at various stages of fabrics production processes, in the food industry for drying diverse products and foodstuffs both during their manufacture and storage in storehouses, for drying dyed, coloured or painted components and products practically in every field of the national economy, as well as for preheating various equipment, such as instruments, machine tools, electric motors before starting.

As a rule, the heating temperature in such drying installations ranges within 50° to 300° C. depending upon the object to be dried and the required drying conditions.

Conventionally industrial drying installations featuring diverse heat-reception methods are known to comprise a chamber made as a framework provided with a heat screening of the drying zone, fashioned from, for example, fibreglass mats enclosed in a metallic gauze and held to a framework.

Depending upon the temperature drying conditions and the purpose of the drying installation, such driers make use of most diverse means for heat admission into the chamber to dry the objects therein being dried. For instance, in the case of the convective method of heat reception employed as such means can be air heaters with nozzle ducts, in the case of the conductive method, drums, and in the case of the radiation method, directional-action heat energy radiators.

Such chambers, however, are very ponderous and bulky and, therefore need a great deal of metal rolling stock for their manufacture; they consume much power for being preheated, especially at the moment of starting the drier and when changing to a higher temperature regime of drying. In addition, substantial power losses occur due to heat egress through the structural members of the chamber.

In stationary drying installations the devices for placing the objects under drying conditions can be made as trolleys, trucks, carts or stillages in the case of intermittent drying, and in the form of various conveyers in the case of continuous drying.

When drying large-sized painted objects, e.g., machine tools or motor-car components, these are arranged immediately in the chamber.

However, the drying installations of the character set forth above suffer from lack of easy access to the chamber interior where the objects under drying are located.

The present-day constructional arrangements of drying installations are difficult to be used as a base for making mobile drying installations.

The heretofore known industrial drying installations are aimed largely at coping with highly specialized tasks.

A prior-art installation for drying knitwear products (cf. USSR Inventor's Certificate No. 344,243 issued on May 11, 1970, cl. F26B 15/24) is known to comprise a chamber accommodating a conveyor for transferring the products to be dried, means for heat admission to the products being dried in the chamber, and an exhaust fan for withdrawing the used-up heat-transfer agent.

In order to provide access to the objects under drying the present state of the art knows drying installations with folding chambers.

A drying installation (cf. USSR Inventor's Certificate No. 235,634 cl. f26B 9/06, issued 1966) is known to comprise a folding chamber made up by a number of similarly shaped bearing members arranged one above another to form a framework and carrying an elastic covering held thereto, a means for heat admission to the objects under drying located in the chamber, and a means for withdrawing the used-up heat-transfer agent. The chamber is open from above, whereas the bearing members are shaped as hoops, each two of said hoops being articulated to each other through three pairs of straps, each pair of the straps is in turn hinged together so as to make it possible to form the entire chamber. This drying installation is made use of in food industry mostly for drying fruits, berries and mushrooms.

Drying occurs by virtue of hot air fed to the chamber along the piping running on the bottom of the chamber.

When the drying is over, the chamber is folded downwards, thus giving a relatively free access to the objects being dried, inasmuch as the chamber is comparatively small.

Conversely, if such a chamber is too large this proves to be inconvenient in service and interferes with free access to the objects under drying.

SUMMARY OF THE INVENTION

It is a primary and essential object of the present invention to provide a drying installation or tower featuring a free access to the objects under drying inside the chamber regardless of the overall dimensions of the chamber.

It is another object of the present invention to provide a drying installation that would allow one to considerably reduce heat losses during the dring process and enable the installation to be used in the open air in diverse climatic zones.

One more object of the present invention is to provide better conditions for in-service care and maintenance of the drying installation proposed herein.

This object is accomplished due to the fact that a drying installation, according to the invention comprises a folding or collapsible chamber composed of a number of similarly shaped bearing members arranged one above another to form a framework and carry an elastic covering. A means for heat admission to the objects for drying is provided. The means is situated inside the chamber, and means for withdrawing the used-up heat-transfer agent are located in the top portion of the chamber. According to the invention the folding or collapsible chamber is built up of a plurality of interlinked individual sections. Each of the sections is made up by two bearing members carrying an elastic covering capable of retaining intactness when under the the chamber weight when the chamber or tower is in use, whereas the top bearing member of the upper section has a means for holding the chamber depending from a support. Provision is made for a means for raising the chamber and collapsing it, said means comprising at least three wire ropes, one of the ends of each of the ropes being fixed on one of the bearing members of the lower section so as to ensure approximately parallel movement of the bearing members when the chamber is being raised, and lowered or collapsed. The wire ropes being arranged in guideways provided at the places where the chamber sections are inlerlinked, and a mechanism for rope reeling, to which the other ends of said ropes are secured.

To reduce the linear dimensions of the chamber as to height (while in the folded state), it is desirable that the area bounded by the outside dimension of the top bearing member of each section be smaller than the area bounded by the inside dimension of the bottom bearing member by a value large enough for the chamber sections to accommodate one another when the chamber is in its topmost position.

In order that the drying installation allow one to hold the required temperature conditions of the drying process for a prolonged period of time the chamber sections may be provided with an additional elastic covering fixed in position with a clearance relative to the main elastic covering on the bearing members on the outside of the chamber.

To ensure against the contact of the main and additional elastic coverings and retain a heat-insulating air space therebetween, it is expedient that a gauze of a heat-insulating material be interposed between the main and additional elastic coverings.

Under high drying temperatures (up to 3000° C.) it is favourable that the main elastic covering of each section be made from multiply fibre-glass cloth polymer-impregnated for heat resistance.

Whenever the drying installation is to operate in the open air it is expedient that the additional elastic covering of each section be made of canvas impregnated with a water-repellant agent.

Such a constructional arrangement of the drying installation chamber provides for a free access to the objects under drying after terminating the drying process irrespective of the overall size of the drying installation and drying conditions.

The drying installation of the character set forth herein can be applied in diverse branches of industry, such as textile, light, food, industries, as well as in personal-service establishments, machine-building industries, and some other fields involving drying temperatures up to 300° C. and repeated use of the drying installation.

Such a drying installation may be made both stationary and mobile, and is applicable indoors, in industrial premises, and in the open air.

The herein-proposed drying installation is instrumental in improving to a great extent the labour conditions and saving electric power, by making use of conventional heating and ventilating units devices for arranging the objects under drying.

Other objects and advantageous features of the herein-proposed invention will become apparent below in the course of a detailed description thereof.

BRIEF DESCRIPTION OF THE DRAWINGS

In what follows the present invention is illustrated in a disclosure of some practical embodiments thereof given by way of example with reference to the accompanying drawings, wherein.

DESCRIPTION OF THE PREFERRED EMBODIMENTS

Figure 1:
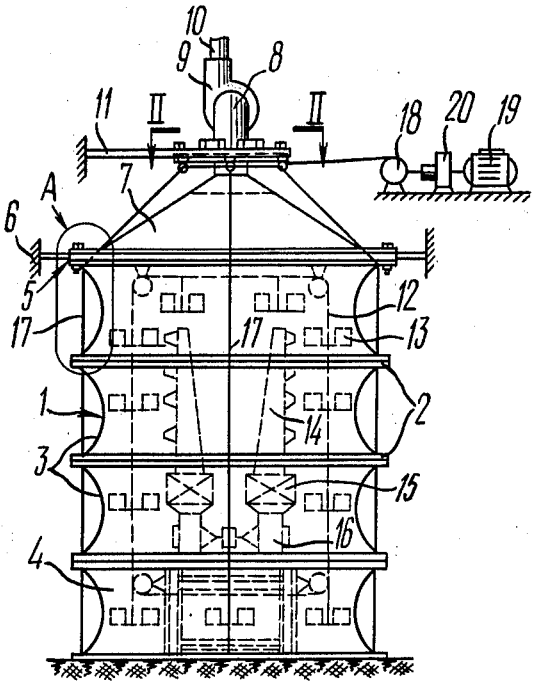
FIG. 1 is a front-elevation view of a drying installation with a device for arranging the object under drying shaped as a vertical conveyer, according to the invention.

The drying installation illustrated in FIG. 1 is described hereinafter with reference to an installation for drying bobbin yarn at a maximum temperature of 120° C.

The installation under consideration comprises a folding chamber 1 built up of a number of similarly shaped bearing members 2 arranged one above another to form a framework. The side surface of the chamber 1 is made as four rigidly interlinked individual sections 3. Each of the sections 3 is established by two bearing members 2 with an elastic covering 4. The chamber 1 is cylinder-shaped, while its bearing members 2 are in fact equidiametral hoops.

The bearing members 2 may be of any arbitrary shape, such as square, triangle, polygon, or have a contour following that of the object to be dried (when the object is a large-sized one), as well as be shaped as a device for arranging the objects being dried. The size of the bearing members 2 depends upon the drying conditions and is determined by the overall dimensions of the object being dried or of a device for arranging the object being dried.

Used as the covering 4 is a multi-ply polymer-impregnated fibre-glass cloth which enables the drying process to run at a maximum temperature of 300° C. with but negligible heat losses. However, there may be used some other materials as the elastic covering 4, such as covering cloths, canvas, polyethylene film, depending upon the required drying temperature.

The bearing members 2 of each of the sections 3 are spaced apart at a distance depending upon the operating conditions. When the drying installation has to operate outdoors the bearing members 2 are to be spaced more closely than those of a drying installation operating indoors. In the former case account must be made of weather conditions, e.g., the effect of wind.

The elastic covering 4 should be so strong as to prevent the chamber 1 against getting deformed by its own weight in the course of a repeated use thereof.

The number of the sections 3 per chamber 1 depends upon the height of the object being dried, or of the device for arranging said object.

The hoops which are in fact the bearing members 2, are made of a low specific-gravity material, such as Duralumin rolled stock. The top bearing member 2 of the upper section 3 has a means 5 for holding the chamber to a support 6 for which purpose use can be made of the bearing structures of industrial buildings (such as frames, beams, girders, trusses, ceilings, etc.). The chamber 1 can be mounted on the support 6 which can be both inside and outside an industrial structure.

The bottom bearing member 2 of the lower section 3 of the chamber 1 is to fit tightly to the floor; therefore the overall size of the chamber 1 (while in the bottommost position) provides for ensuring a tight fit. It is preferable for the chamber 1 to be kept in the bottommost position or intended during inactive periods.

In addition, a hood 7 made of polymer-impregnated multiply cloth is fixed in position on the top bearing member 2 of the upper section 3, viz., on the bellmouth of a vent dome 8 of the exhaust-fan unit adapted to withdraw waste heat-transfer agent from the chamber 1. The exhaust fan unit incorporating the vent dome 8, a fan 9 and a conduit 10, is made fast on a frame 11. Located inside the chamber 1 is the device for arranging the object under drying, made as vertical conveyer 12 carrying baskets 13, wherein yarn-wound bobbins are accommodated.

The means for heat admission into the chamber 1 to dry yarn-wound bobbins is made as an air heater 14 provided with nozzle ducts 15, and a blower-fan 16 for forcing air towards the objects undergoing drying.

The herein-proposed drying plant for desiccating various materials may be implemented both as a stationary and portable unit. The latter being the case, the heat-admission means and the exhaust-fan unit are situated outside the chamber, whereas flexible conduits through which the drying agent, viz. hot air, is fed, and the used-up air is withdrawn, run into the chamber. Any type of devices for arranging the objects under drying can be made use of depending upon the type of the objects being dried.

In the case of a stationary drying plant use can be made of the now available serially manufactured heat- and vent units and devices for arranging the object under drying, such as trolleys, bogeys, or stillages for an intermittent-duty drier, and diverse kinds of conveyers, for a continuous-duty drier.

The drying plant comprises also a chamber raising device which incorporates four wire ropes 17 with one of their ends made fast on the bottom bearing member 2 of the lower section 3. The ropes 17 can be secured by, say, a threaded joint at equal distance on the hoops, i.e., at the ends of the mutually square diameters of the bottom bearing member 2 of the lower section 3. As a rule the number of the ropes 17 is at least three, depending upon the shape of the bearing members 2. The ropes can be made fast on one of the bearing members 2 of the lower section 3 in such a way as to preclude cocking of the bearing members 2 and provide for an approximately parallel travel of the bearing members 2 when the chamber 1 is being raised.

Guideways are provided at the joints of the sections 3 of the chamber 1, for the ropes 17 to run in.

The other ends of the ropes 17 are connected to a rope reeling drum 18 which is locked-in with the shaft of an electric motor 19 through a reduction unit 20.

Figure 2:
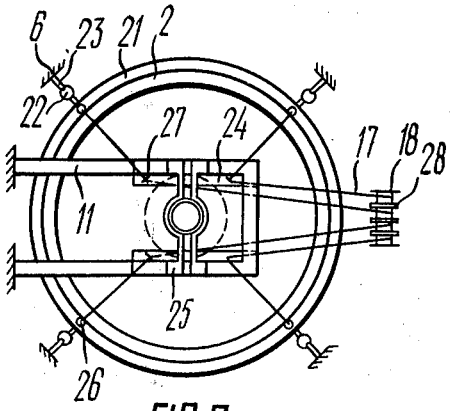
FIG. 2 is a section view taken along the section line II—II in FIG. 1 (with the drying chamber turned purposely through 45°) to illustrate how the drying chamber is attached to its support, according to the invention.

The means 5 for holding the chamber to the support comprises a ring 21 (FIG. 2) locked in place on the top bearing member 2 of the upper section 3. The ring 21 has four eyebolts 22 through which the chamber 1 is held to the support 6 by means of wire ropes 23, the walls of an industrial structure serving as said support.

The exhaust-fan unit is secured on the frame 11 in the following manner: two plates 24 are bolted to the frame 11, to which plates are held two brackets 25 embracing the vent dome 8 of the exhaust-fan unit and supporting the hood 7 of the folding chamber 1. In addition, the ring 21 has four guide holes for the ropes 17 of the chamber raising device to pass.

The bottom surface of the plates 24 carries four swivel rollers 27 (to suit the number of the ropes 17), provided with holes for the ropes 17 of the chamber raising device to pass, the ends of said ropes being held to the drum 18 of the rope reeling mechanism. The drum 18 has three partitions 28 dividing it into four compartments. Each of the ropes 17 is fixed in position in one of the compartments, which prevents the ropes 17 from whipping together and provides for their uniform reeling.

Figure 3:
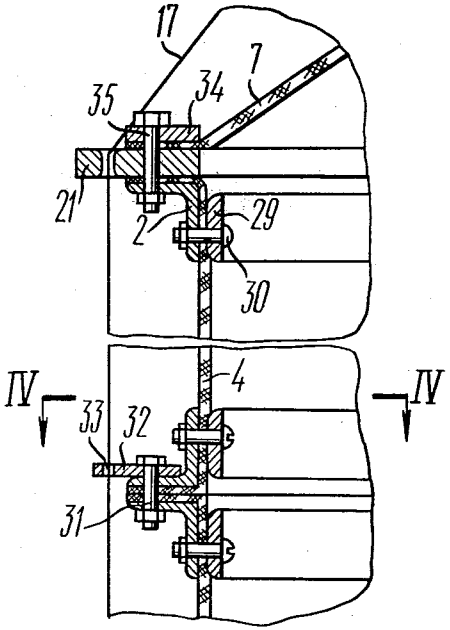
FIG. 3 is a fragmentary scaled-up longitudinal-section view of the unit A in FIG. 1, according to the invention.

Each section 3 of the chamber 1 is made up by two hoops between which the elastic covering 4 (FIG. 3) is stretched.

The hoops which are in fact the bearing members 2, are made up by separate angle bars. The elastic covering 4 is tightly held from the inner side of the bearing member 2 by strips 29 adjoining along the entire perimeter of the bearing member 2 and fastened to one of the edges of the angle bars with bolts 30, while the other adges of the adjacent sections 3 face each other so as to tightly hold therebetween the elastic covering 4 of the adjacent sections 3 interlinked by twelve bolts 31. Plates 32 are provided at the places of interlinking of the sections 3, made fast on the angle bars by said bolts 31.

The plates 32 are so held that part thereof projects beyond the edge of the angle bar, said part having a guide hole 33 for the rope 17, said holes 33 being arranged one above another. The size and shape of said quide holes 33 are such as to allow the ropes 17 to freely pass therethrough while the chamber 1 is being raised or lowered.

The elastic covering 4 of the upper section 3 is held to the top bearing member 2 by the face surface of the ring 21, while the elastic covering 4 of the hood 7 is held to the other side of said ring 21 by a strap 34.

Figure 4:
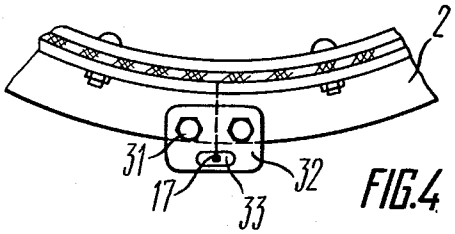
FIG. 4 is a section view taken along the line IV—IV in FIG. 3 to give a plan view of a guideway device for raising the folding chamber, according to the invention.

The top bearing member 2, the ring 21, the strap 34 and the elastic covering 4 of the upper section 3 and the hood 7 are braced together by bolts 35. Each of the plates 32 is secured by the two bolts 31 (FIG. 4) to ensure against turning the plates 32 when the chamber 1 is being raised.

Figure 5:
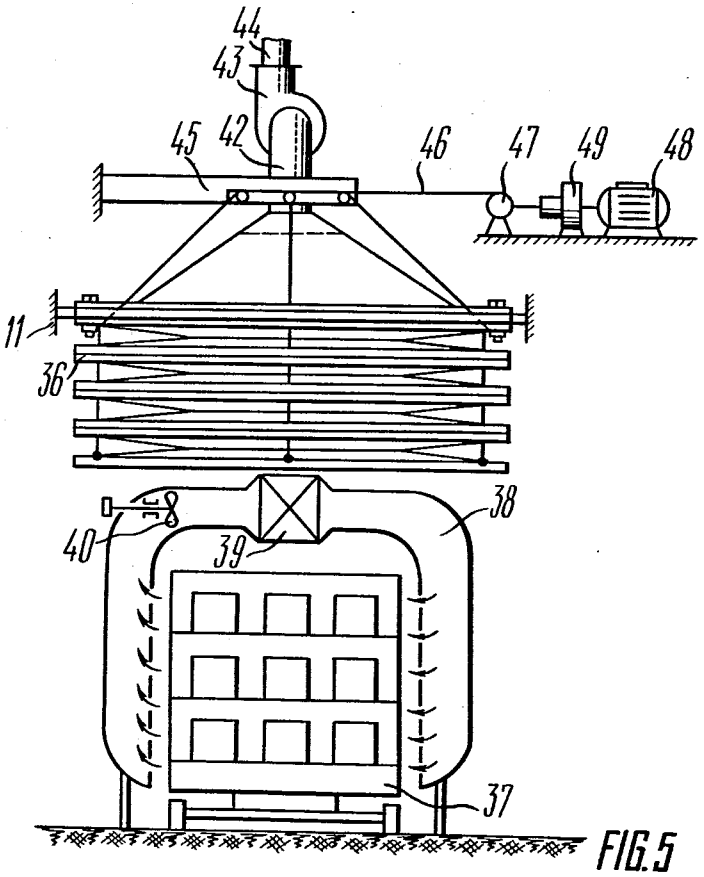
FIG. 5 is a front-elevation view of a drying installation with a movable device for arranging the object under drying, showing the folding chamber in its topmost position, according to the invention.

FIG. 5 illustrates an embodiment of the drying plant according to the present invention, comprising a folding chamber 36 similar in construction to the chamber 1 as represented in FIG. 1. The device for setting the object to be dried is made as a trolley 37 which carries, say, baskets containing prepacked food products.

The means for heat admission to the object under drying incorporates a nozzle duct 38 embracing the trolley 37, an air heater 39 and an exhaust fan 40 for withdrawing waste air from the duct 38 in the direction shown by the arrows in FIG. 5. The chamber 36 is shown in a folded position, with the bottom bearing member 2 arranged above the nozzle duct 38 so as to provide a free access to said duct and enable the trolley 37 to be dislodged freely from the drying zone.

All the remaining structural elements of the drying plant are similar to those of the drying plant shown in FIG. 1.

The chamber 36 is fixed on a support 41. The exhaust-fan unit, comprising a vent dome 42, an exhaust fan 43 and a conduit 44, is fastened to a frame 45. The chamber raising device incorporates likewise four wire ropes 46 which run in guideways and are held with one of their ends to the bottom bearing member of the lower section of the chamber 36, and with the other ends, to a rope reeling mechanism drum 47 locked-in with the shaft of an electric motor 48 through a reduction unit 49.

Inasmuch as the national economy of the country deals with a great variety of most diverse products having a quite unexpected and intricate configuration which need to be dried and require various devices for being arranged in the drying plant, it is not infrequent that the space of the top portion of the drying chamber is utilized but incompletely. Some occasions are encountered whenever there is necessary to dry some materials on mobile devices or the mobile object itself, where the working portion of the chamber, while in the raised position, interferes with a free setting of the object under the chamber, through a considerable vacant useful drying space remains under the raised working portion of the chamber.

Figure 6:
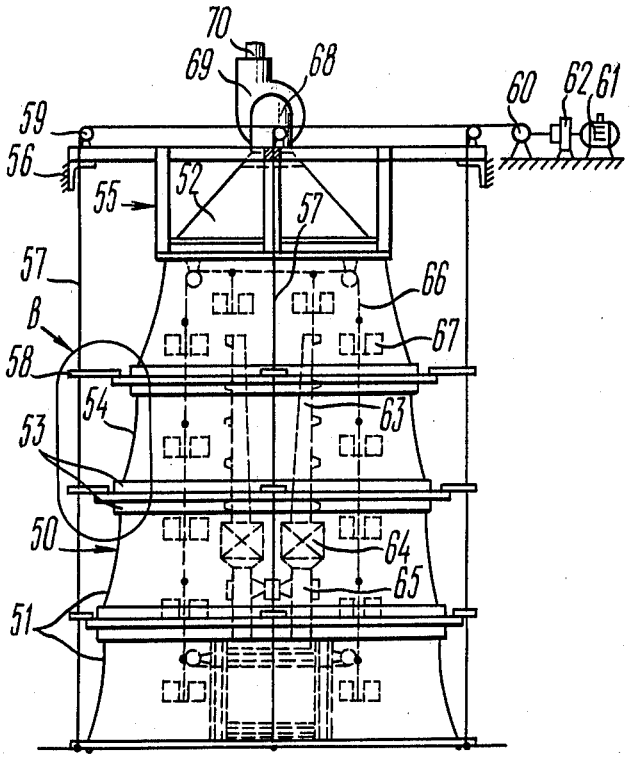
FIG. 6 is a front-elevation view of a drying installation having a chamber capable of telescoping, according to the invention.

In order to reduce the linear dimensions of the folding drying chamber as to height or length (while in the folded position), to utilize most efficiently the whole useful volume of the drying plant chamber and to cut down losses of heat under high-temperature drying conditions, it is expedient to use a telescopically folding chamber 50 (FIG. 6). The chamber 50 consists of four individual sections 51 and a hood 52 butt-joined thereto from above. Each of the sections 51 is formed by two bearing members 53 embraced with an elastic covering 54. The area bounded by the outside dimension of the top bearing member 53 of each section 50 is smaller than the area bounded by the inside contour of the bottom bearing member 53 of each section 50 by a value large enough for the sections 51 of the chamber 50 to accommodate one another when the chamber 50 is in its top-most position. The bearing members 51 are shaped as hoops, the diameter of the top hoop in each of the sections 51 being smaller than the diameter of the bottom hoop thereof. The buttjoined hoops of the adjacent sections 51 are in equal in diameter.

The means for holding the chamber to the support is made as a truss 55 locked-in with the top bearing member 53 of the upper section 51 and made fast on a support 56.

The drying plant chamber raising device incorporates four ropes 57 running in guideways 58 and fixed with one of their ends to the bottom bearing member 53 of the lower section 51 at the ends of the mutually square hoop diameters. Fixed in place on the truss 55 are four guide rollers 59 for ropes 57 to pass. The other ends of the ropes 57 are held in position to a drum 60 of the rope reeling mechanism, said drum being locked-in with the shaft of an electric motor 61 through a reduction unit 62.

The means for heat admission inside the chamber to the object being dried is made similar to that shown in FIG. 1 and comproses nozzle ducts 63, an air heater 64 and a blower-fan 65.

The device for accommodating the object being dried is also made as a vertical conveyer 66 carrying baskets 67.

The means for withdrawing used-up heat transfer agent, viz., the exhaust-fan unit, comprises a vent dome 68, an exhaust fan 69 and a conduit 70.

Figure 7:
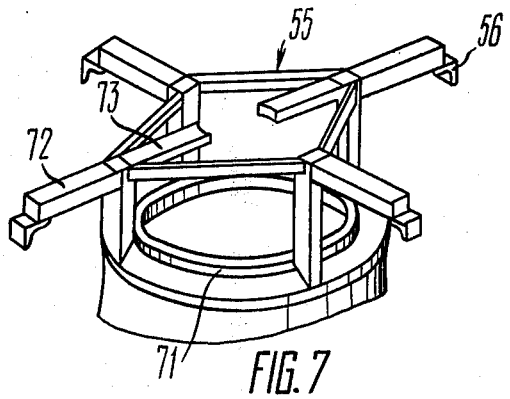
FIG. 7 is an isometric view of a truss for holding the chamber to a support, as shown in FIG. 6, according to the invention.

FIG. 7 illustrates the truss 55 for holding the chamber to the support, made as a ring 71 for attaching the hood 52, and four cross-bars 72 mounted on the supports 56, two of said cross-bars 72 having projections 73 for mounting the exhaustfan unit thereon.

Figure 8:
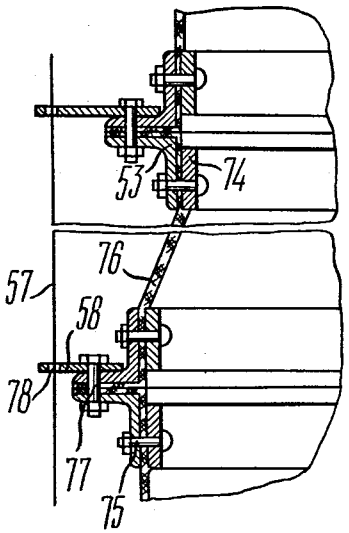
FIG. 8 is a fragmentary scaled-up longitudinal-section view of the unit B interlinking the chamber sections, according to the invention.

The hoops which are in fact the bearing members, are composed of Duralumin angle bars; an elastic covering 76 made of a multi-ply polymer-impregnated fibre-glass cloth is held to said angle bars from inside through strips 74 (FIG. 8) and bolts 75 to form a cone-shaped side surface of the sections 51 of the chamber 50. All the sections 51 of the chamber 50 are interconnected by bolts 77.

The guideways 58 made as plates with holes 78 are provided at the places of joining the sections 51 with each other, said guideways being fixed by said bolts 75 in such a manner that one of the ends thereof protrudes beyond the edge of the angle bar for such a length that the edges of one of the four plates secured at the places of interlinking of the sections 51 are arranged one below another. The abovesaid holes 78 are made in the projecting portion of the plates for the ropes 57 to pass, said holes being arranged one above another.

Figure 9:
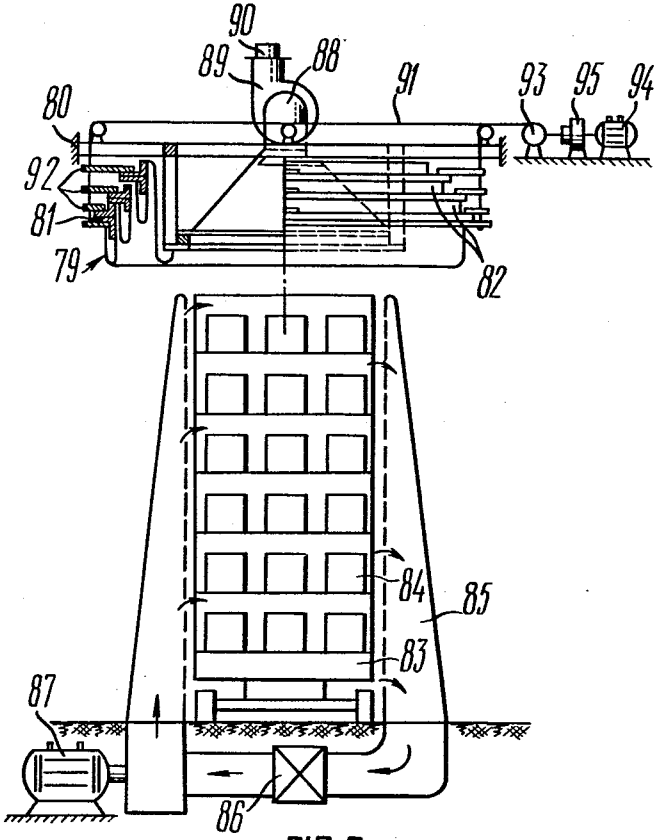
FIG. 9 is a front-elevation view of a drying installation showing its telescopically extensible chamber in the topmost position, according to the invention.

FIG. 9 illustrates one more embodiment of the proposed drying plant, wherein a folding chamber 79 thereof is shown in a folded state. All the sections of the chamber 79 are raised to assume the top-most position and are fixed under a support 80. Bearing members 81 accommodate one another, whereas an elastic covering 82 sags loosely between the bearing members 81. The device for accommodating the object under drying is made as a trolley 83 carrying baskets 84 which contain the objects being dried. The means for heat admission incorporates nozzle ducts 85 embracing the trolley 83, an air heater 86 and a blower-fan 87. The direction of hot air flow is indicated with arrows. The exhaust-fan unit for withdrawing used-up heat-transfer agent is made similarly to that described in the afore-described embodiments of the drying plant, and comprises a vent dome 88, an exhaust fan 89 and a conduit 90.

The raising device of the chamber 79 is similar to those set forth with reference to the above-described embodiments of the drying plant, and incorporates four wire ropes 91, their guideways 92, and a drum of the rope reeling mechanism, locked-in with the shaft of an electric motor 94 through a reduction unit 95.

The drying plant of the character set forth above is much less expensive than one shown in FIG. 1 as it is capable of considerably cutting down the consumption of an elastic covering in the capacity of which use is made of a polymer-impregnated multi-ply fibre-glass cloth.

Figure 10:
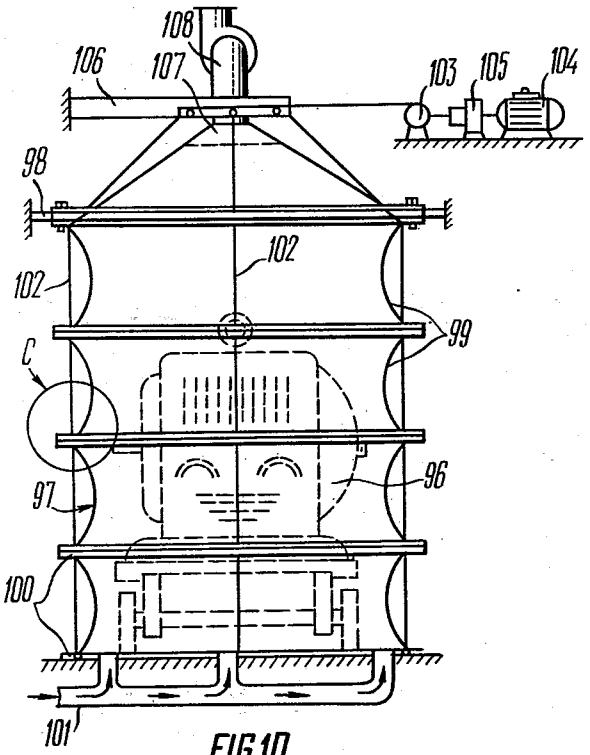
FIG. 10 is a front-elevation view of an embodiment of the drying installation for warming up electric motors, according to the invention.

The drying plant designed for warming up electric motors 96 (FIG. 10) is to be used, as a rule in the open air, its chamber 97 being held to a support 98.

The drying plant comprises the chamber 97 made up by four sections 99, each of which being composed by two bearing members 100 made as equidiametral hoops. Used as a means for heat admission is a conduit 101 located in the portion of the drying plant. The direction of hot air flow is shown by the arrows.

All the remaining structural elements of said drying plant are similar to those described gereinbefore with reference to the aforedisclosed embodiments of the drying plant.

The chamber raising device comprises four wire ropes 102 running is guideways and fixed with one of their ends to the bottom bearing member 100 of the lower section 99, and with the other ends, to a drum 103 of the rope reeling mechanism. The drum 103 is locked-in with the shaft of an electric motor 104 through a reduction unit 105.

The means for withdrawing used-up heat-transfer agent, viz., the exhaust-fan unit comprises a vet dome 107 and an exhaust fan 108 with a conduit, all these being mounted on a frame 106.

Figure 11:
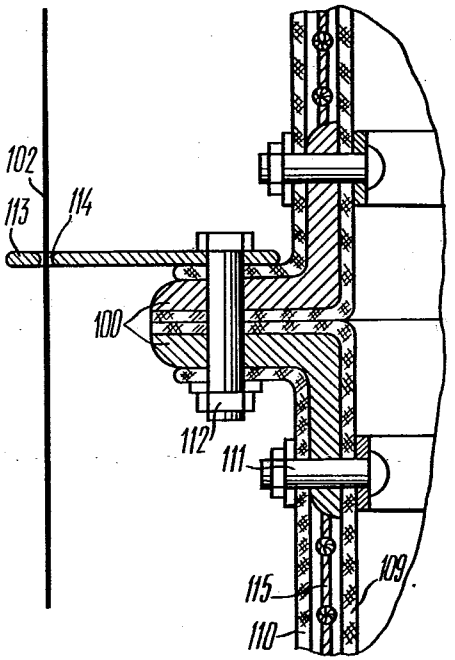
FIG. 11 is a fragmentary scaled-up longitudinal-section view of the unit C interlinking the chamber sections.

Each of the sections 99 of the chamber 97 has a main elastic covering 109 (FIG. 11), in the capacity of which a polymer-impregnated multi-ply fibre-glass cloth is employed, and an additional elastic covering 110 spaced somewhat apart from the main elastic covering 109 and fixed to the bearing members 100 on the other side of the chamber 97.

For the additional covering 110 canvas impregnated with a water-repellant agent is used.

The main elastic covering 109 and the additional elastic covering 110 are held to the bearing members 100 by bolts 111. The sections 99 are interconnected through bolts 112. At the places of interconnection of the sections 99 said bolts 112 secure plates 113 having guide holes for the ropes 102 to pass.

A network 115 made of a heat-insulating material, such as linen, hemp, jute, etc. is interposed between the coverings 109 and 110, said network being held to the top bearing member 100 of each of the sections.

The herein-proposed drying plant operates as follows.

In order to charge the chamber 1 (FIG. 1) with yarn-wound bobbins to be dried one must start the motor 19 to reel up the ropes 17 onto the drum 18. As the ropes 17 are fixed in place to the base of the working portion of the chamber 1 on the bottom bearing member 2 and are free to pass through the holes 33 (FIG. 4), all the working sections 3 (FIG. 1) of the chamber 1 are raised without cocking above the floor and fixed under the support 6. Thus, access is gained to the heat and vent units and to the device for accommodating the object under drying. This done, the conveyer 12 is loaded with the objects to be dried, whereupon the working portion of the chamber 1 is let down onto the floor and fixed in a required position. Then the air-heater 14, the blower-fan and the exhaust-fan unit are brought into action, and the drying process with preset technological parameters starts proceeding, the required drying temperature conditions being maintained throughout the process. Upon terminating the drying, the aforesaid units and mechanisms are stopped, and the yarn-wound bobbins are discharged from the drying chamber. Further on the entire drying cycle is repeated as described above.

In order to charge the chamber 50 (FIG. 6) for carrying out the drying process one must start the motor 61 to reel up the ropes 57 onto the drum 60, thereby raising the sections 51 above the floor and fixing them within the zone of the truss 56. Provision of the working portion of the chamber 50 telescopically folding, wherein the hoops of each of the sections 51 of the working portion of the chamber 50 are arranged concentrically to one another, makes it possible to raise the hoops one after another, while raising the bottom hoop, the elastic covering 57 sagging loosely between the hopes. Thus, access is provided to the heat and vent units and to the device for accommodating the object being dried. Next the conveyer 66 is charged, whereupon the working portion of the chamber 50 is let down onto the floor and fixed in a required position. Then the heat and vent units are put into operation to start the drying process with preset technological parameters under required drying temperature conditions maintained throughout the process. Upon terminating the drying, the heat and vent units are stopped, the chamber 50 is raised, and the objects dried are discharged from the drying chamber. Next the entire operating cycle of the plant is repeated as described above.

The drying plants illustrated in FIGS. 5, 6, 9, 10 operate in a way similar to that described with reference to the plant illustrated in FIG. 1, the chamber 36 (FIG. 5) or 79 (FIG. 9) being raised to the topmost position for the trolley 37 (FIG. 5) or 83 (FIG. 9) to be freely dislodged from the drying zone.

If the elastic coverings are deformed during raising the chamber 97 (FIG. 10), the main elastic covering 109 and the additional elastic covering 110 do not contact each other to retain a specified air gap therebetween which ensures required drying temperature conditions.

What is claimed is:

1. A collapsible and extensible tower for drying comprising:

a sectional-construction defining a folding chamber;

bearing members forming sections of said folding chamber, each having a similar annular shape and vertically arranged one above another;

said sections of said folding chamber, each made up of two bearing members one mounted on the other; said sections adjoining one another being rigidly interconnected an elastic covering enclosing two axially spaced said bearing members of each said section and secured to two said bearing members of each said section;

said elastic covering being capable of remaining intact under the weight of said the bearing members of folding chamber and those below it;

a hood made fast on a top bearing member of an uppermost section;

a means for holding said folding chamber to a support for depending therefrom, said means being linked to said top bearing member of said upper section;

a means for admission of heat to said folding chamber, situated inside said chamber;

a means for withdrawing air from said chamber, arranged on said hood;

at least three suspension wire ropes with one of their ends held to one of said bearing members of said lower section so as to provide approximately parallel travel of said bearing members when actuated by said ropes;

guideways through which said equal in number to the number of said ropes and located at the places of interlinking of said sections of said chamber.

2. A drying tower as claimed in claim 1, comprising:

each of said sections defining an area bounded by the outside dimension of said top bearing members thereof being smaller than the area bounded by the inside dimension of said bottom bearing member by a value large enough for the chamber sections to accommodate one another when said chamber is in its topmost and collapsed position.

3. A drying tower as claimed in claim 1, comprising:

said elastic covering made of a polymer-impregnated multi-ply fibre-glass cloth.

4. A drying tower as claimed in claim 1, comprising:

a second elastic covering spaced somewhat apart from the first-mentioned elastic covering and circumferentially thereof and made fast on said bearing members of each of said sections on the outer side of said chamber.

5. A drying tower as claimed in claim 4, comprising:

a network made from a heat-insulating material and interposed between said first-mentioned and second elastic coverings.

6. A drying tower as claimed in claim 2, comprising:

said first-mentioned elastic covering made of a polymer-impregnated for heat resistance multi-ply fibre-glass cloth.

7. A drying tower as claimed in claim 2, comprising:

a second elastic covering spaced somewhat apart from said first-mentioned elastic covering and made fast on the bearing members of each of said sections on the outer side of said chamber.

8. A drying tower as claimed in claim 3, comprising:

a second elastic covering spaced somewhat apart from the first-mentioned elastic covering and made fast on said bearing members of each of said sections on the outer side of said chamber.

9. A drying tower as claimed in claim 4, comprising:

a network made of a heat-insulating material and interposed between said first-mentioned and second elastic coverings.

10. A drying tower as claimed in claim 4, in which said second elastic covering is made of canvas impregnated with a water-repellant agent.

11. A drying tower as claimed in claim 5, in which said second elastic covering is made of canvas impregnated with a water-repellant agent.

12. A collapsible and extensible tower for drying articles therein comprising, a plurality of communicating enclosed chamber sections positionable axially contiguous of each other defining an enclosed chamber; each chamber section comprising paired hoops axially spaced and a flexible foldable fabric disposed between successive hoops and secured thereto defining a corresponding enclosed section of the enclosed chamber; a support for suspending said chamber sections in a collapsed condition and in an extended depending condition defining the chamber; a plurality of ropes secured to a lowermost of said hoops for lowering the hoops from a raised position to a lowered position in which the collapsible chamber is in an extended condition and for raising the hoops upwardly for collapsing the chamber; guide means on the hoops through which the wire ropes extend longitudinally; means for securing the uppermost loop to said support; a hood at the top of the uppermost chamber section in communication therewith; take-up means to take up the ropes to pick up the lowermost loop of the extended chamber and raise it to collapse the chamber and to lower it to extend the fabric of each chamber section to dispose the chamber in an extended condition; said fabric of each section defining the chamber sections depending one from the other and constituting the sole support between the contiguous chamber sections when the lowermost of the loops has been lowered to extend and define the chamber; means to heat the air within the chamber when in an extended condition;

and means communicating with said hood for exhausting through said hood air out of said enclosed chamber when in an extended condition.

13. A collapsible and extensible tower according to claim 12, in which said hoops have substantially equal inner and outer dimensions.

14. A collapsible and extensible tower according to claim 12, in which the hoops have unequal inner and outer dimensions to allow telescoping of the chamber sections and the hoops increase in size in a direction toward the lowermost loop which has the largest inner and outer dimensions, whereby the chamber sections telescope when in the chamber is taken-up and is in a raised condition.

* * * * *